US005647190A

United States Patent [19]

Minarelli et al.

[11] Patent Number: 5,647,190

[45] Date of Patent: Jul. 15, 1997

[54] METHOD AND MACHINE FOR PRODUCING TWIN PACKETS OF CIGARETTES

[75] Inventors: Alessandro Minarelli, Bazzano; Roberto Osti, Zola Predosa, both of Italy

[73] Assignee: G.D Societa' Per Azioni, Bologna, Italy

[21] Appl. No.: 339,955

[22] Filed: Nov. 15, 1994

[30] Foreign Application Priority Data

Nov. 29, 1993 [IT] Italy ..... BO93A0476

[51] Int. Cl.[6] ..... B65B 35/56

[52] U.S. Cl. ..... 53/446; 53/143; 53/171; 53/228; 53/544; 53/449; 53/466; 198/377; 198/404; 198/411; 198/471.1; 198/474.1

[58] Field of Search ..... 198/374, 377, 198/379, 416, 403, 404, 410, 411, 471.1, 474.1, 475.1; 53/443, 446, 448, 449, 466, 228, 143, 144, 171, 544; 131/283

[56] References Cited

U.S. PATENT DOCUMENTS

| | | | |
|---|---|---|---|
| 3,834,516 | 9/1974 | Reeser | 198/416 |
| 3,868,009 | 2/1975 | Billi et al. | 198/377 X |
| 4,086,744 | 5/1978 | Seragnoli | 198/416 X |
| 4,798,278 | 1/1989 | Cornacchia | 198/404 X |
| 4,883,163 | 11/1989 | Gamberini et al. . | |
| 5,090,553 | 2/1992 | Focke | 198/377 |
| 5,188,212 | 2/1993 | Munsch | 198/377 X |
| 5,318,165 | 6/1994 | Spatafora et al. | 198/471.1 X |
| 5,417,037 | 5/1995 | Osti et al. | 53/446 |
| 5,447,013 | 9/1995 | Boriani et al. | 53/544 X |

FOREIGN PATENT DOCUMENTS 2 275 245 8/1994 United Kingdom .

*Primary Examiner*—Daniel Moon

*Attorney, Agent, or Firm*—Marshall, O'Toole, Gerstein, Murray & Borun

[57] ABSTRACT

A method and machine whereby two rigid packets, traveling in a first direction parallel to the longer longitudinal axes of the packets, are transferred to the inputs of respective conveyors, one of the two packets being rotated 180° about its longitudinal axis, and the other packet being rotated 180° about an axis crosswise to its longitudinal axis; and the two packets are fed along the respective conveyors in a second direction crosswise to the respective longer longitudinal axes and to the crosswise axis into a position wherein the two packets present a common longitudinal axis, are oppositely oriented along the common longitudinal axis, are rotated 180° in relation to each other about the common longitudinal axis, and are connectable to form a twin packet.

12 Claims, 4 Drawing Sheets

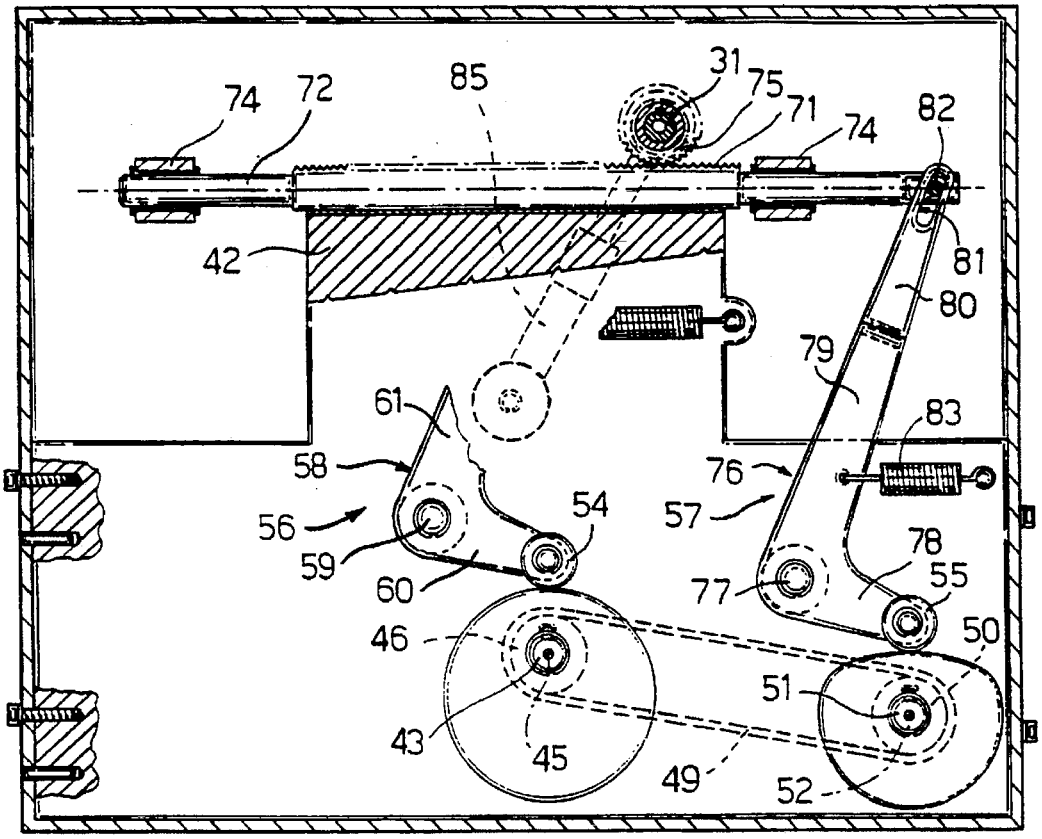
Fig.6
Fig.3
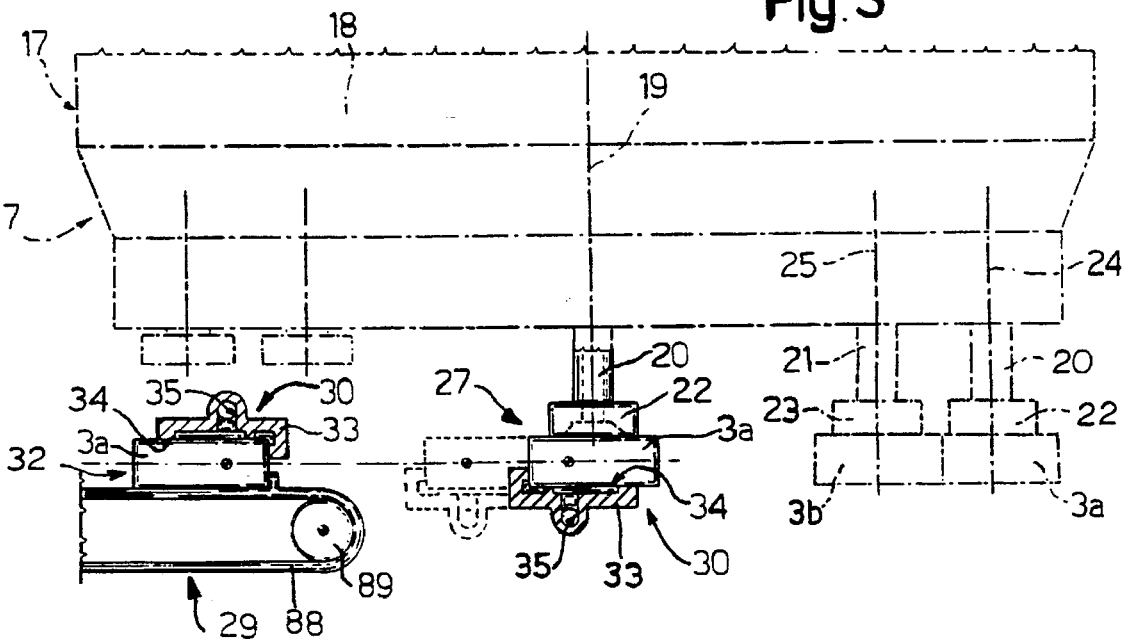

METHOD AND MACHINE FOR PRODUCING TWIN PACKETS OF CIGARETTES

BACKGROUND OF THE INVENTION

The present invention relates to a method of producing twin packets of cigarettes.

Twin packets of cigarettes are known to be produced using the method described in Italian Patent Application n. BO93 A000061 filed by the present Applicant, U.S. Pat. No. 5,417,037, and whereby a first and second rigid packet traveling in a first direction parallel to the longer longitudinal axes of the packets are transferred to the inputs of respective feed channels, the second packet being rotated 180° in relation to the first; the two packets so arranged are fed along the respective channels in a second direction crosswise to the respective longer longitudinal axes and into a position coaxial with but axially spaced in relation to each other; the bottom wall of one of the two packets is gummed; and the packets are then brought together so that the respective bottom walls adhere to each other to form a twin packet.

The above known method therefore provides for producing twin packets presenting, at opposite ends, two hinged lids both opening on the same side; which lid arrangement is unsatisfactory not only in appearance, due to the difference in the larger lateral surfaces of the twin packet, but also structurally, in that the resistance to deformation of the front wall of the twin packet is less than that of the rear wall, thus resulting in possible twisting of the twin packet as a whole.

SUMMARY OF THE INVENTION

It is an object of the present invention to provide a method of producing twin packets, designed to overcome the aforementioned drawbacks.

According to the present invention, there is provided a method of producing twin packets of cigarettes, each twin packet comprising two single packets aligned with and oppositely oriented in relation to each other; the method comprising the steps of feeding the single packets in an orderly succession and in a first direction parallel to first longer longitudinal axes of the single packets; transferring the two single packets in each pair of adjacent single packets in said succession to the inputs of respective feed devices, and imparting to one of the single packets in each pair a first 180° rotation about a second axis crosswise to the respective first axis; and feeding said two single packets along the respective feed devices, and in a second direction crosswise to the respective first axes, into an assembly position wherein the first axes of the two single packets are coaxial with each other, and such as to permit connection of the facing ends of the single packets; the method being characterized in that it comprises the further step of imparting to one of the single packets in each said pair a second 180° rotation about the respective first axis so that, in said assembly position, the two single packets present a common first axis, are oppositely oriented along the common first axis, and are rotated 180° in relation to each other about the common first axis.

The present invention also relates to a machine for producing twin packets of cigarettes.

According to the present invention, there is provided a machine for producing twin packets of cigarettes, each twin packet comprising two single packets aligned with and oppositely oriented in relation to each other; the machine comprising first conveyor means for feeding the single packets in an orderly succession and in a first direction parallel to first longer longitudinal axes of the single packets; a first and second feed device located substantially side by side, for feeding respective single packets in a second direction crosswise to the respective said first axes, and for feeding the respective single packets into an assembly position wherein each single packet is coaxial with another single packet in a direction crosswise to said second direction; and transfer means for transferring the single packets in each pair of adjacent single packets in said succession from the first conveyor means to respective said feed devices; said transfer means comprising first gripping means rotating about respective second axes for successively gripping the single packets and imparting to one of the single packets in each said pair a first 180° rotation about a said second axis and in relation to the respective other single packet; the machine being characterized in that it also comprises a turnover device in turn comprising a support rotating about a third axis substantially perpendicular to the second axis, and which provides for receiving one single packet of each said pair with its first axis parallel to said third axis; and actuating means for imparting to the rotary support a second 180° rotation about the third axis so that, in said assembly position, the two single packets present, in use, a common longitudinal axis, are oppositely oriented along the common longitudinal axis, and are rotated 180° in relation to each other about the common longitudinal axis.

BRIEF DESCRIPTION OF THE DRAWINGS

A non-limiting embodiment of the present invention will be described by way of example with reference to the accompanying drawings in which:

FIG. 3 shows a larger-scale section along line III—III in FIG. 1;

FIGS. 5 and 6 show sections along lines V—V and VI—VI in FIG. 4;

DETAILED DESCRIPTION OF THE INVENTION

Figure 1:
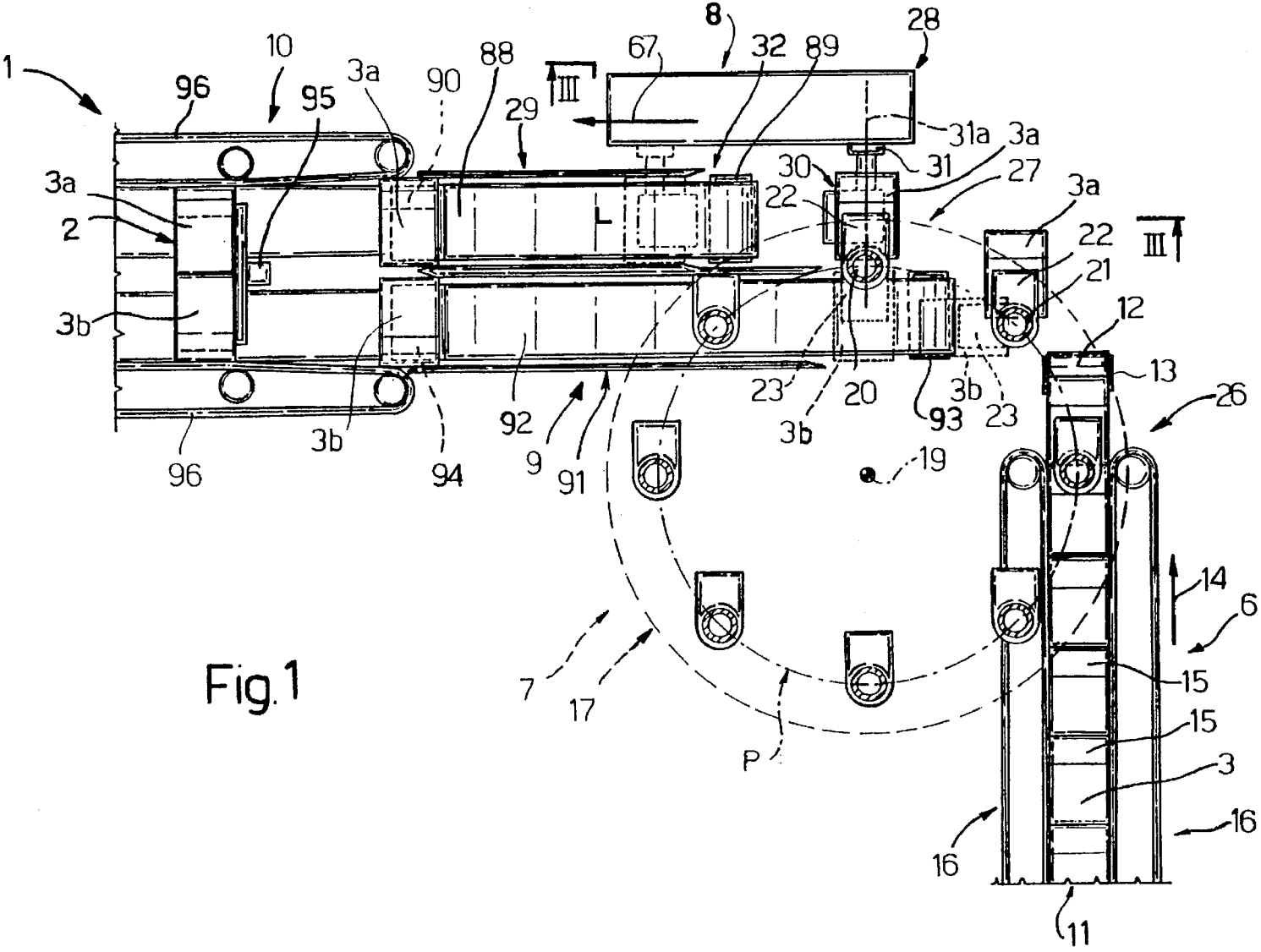
FIG. 1 shows a partially sectioned plan view, with parts removed for clarity, of a preferred embodiment of the machine according to the present invention.
Figure 2:
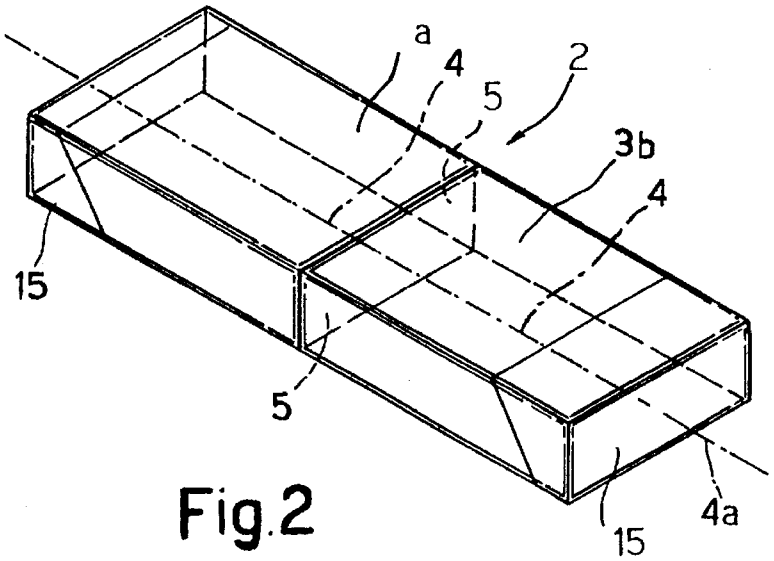
FIG. 2 shows a view in perspective of a twin packet of cigarettes formed on the FIG. 1 machine.

Number 1 in FIG. 1 indicates a machine for producing twin packets 2, each of which, as shown more clearly in FIG. 2, comprises two single rigid hinged-lid packets 3 numbered 3*a* and 3*b*, the longer longitudinal axes 4 of which are coaxial with each other along a common axis 4*a*. Packets 3 of each twin packet 2 are oppositely oriented, are rotated 180° in relation to each other about axis 4*a*, and are connected integral with each other at facing, mutually contacting bottom walls 5.

With reference to FIG. 1, machine 1 comprises an input device 6 for packets 3; an intermediate device 7 for transferring packets 3; and two feed devices 8 and 9 for receiving respective packets 3 from device 7 and feeding them in pairs to an assembly device 10.

With reference to FIG. 1, input device 6 comprises a substantially horizontal conveyor 11 defined by a belt 12 looped about pulleys 13 (only one shown), and which provides for feeding, in a substantially horizontal first direction 14, a continuous succession of equioriented packets 3 laid flat with axes 4 parallel to direction 14, arranged contacting one another, and with lids 15 facing forwards. Packets 3 are kept aligned on conveyor 11 by two lateral conveyors 16 located on either side of conveyor 11 and on the top transportation branch of belt 12.

With reference to FIGS. 1 and 3, intermediate transfer device 7 comprises a known carousel conveyor 17 substantially of the type described in U.S. Pat. No. 4,883,163. Conveyor 17 comprises a rotary head 18 rotated anticlockwise (in FIG. 1) about a substantially vertical axis 19 by known drive means (not shown); and underneath presents two numbers of alternating output shafts 20 and 21 equally spaced about axis 19 and rotating about axis 19 together with head 18. At the bottom end, shafts 20 and 21 present respective suction type gripping heads 22 and 23, and are rotated about their own axes 24 and 25, which are parallel to axis 19, at the same angular speed as head 18 by a known epicyclic gear drive (not shown).

More specifically, and as shown schematically in FIG. 1, shafts 20 rotate about their axes 24 in the opposite direction to that of head 18 so that, by virtue of the combined rotation of head 18 and of shafts 20 about respective axes 24, the respective suction heads 22 of shafts 20 are maintained parallel to themselves and to direction 14 at all times. Conversely, shafts 21 rotate about their axes 25 in the same direction as head 18 so that, by virtue of the combined rotation of head 18 and of shafts 21 about respective axes 25, respective suction heads 23 make, in relation to an external reference, two anticlockwise turns (in FIG. 1) about respective axes 25 for each turn of head 18 about axis 19.

Each shaft 20 and 21 is connected in known manner to known actuating means (not shown) housed inside head 18 and which provide for axially moving respective shaft 20, 21 between a raised idle position and a respective lowered operating position. As a consequence of the rotation of head 18, suction heads 22 and 23 (and more specifically respective axes 24 and 25) travel along a substantially circular path P through a pickup station 26 at the output end of conveyor 11 and wherein direction 14 is substantially tangent to path P, and through a transfer station 27 located at the input end of feed devices 8 and 9 and 90° downstream from station 26 along path P in the rotation direction of head 18.

As shown in FIG. 1, conveyor 11 is so timed in relation to conveyor 17 as to feed a packet 3 to station 26 simultaneously with the passage through station 26 of a suction head 22, 23; and suction heads 23 are so timed in relation to suction heads 22 as to be equioriented at station 26 and, hence, oppositely oriented at station 27 in relation to heads 22. In other words, both suction heads 22 and 23 travel through station 26 in a position substantially tangent to path P and facing forwards in relation to respective shafts 20 and 21, whereas they travel through station 27 in a radial position in relation to path P, with head 22 facing outwards and head 23 inwards of path P.

With reference to FIGS. 1 and 3, feed device 8 comprises a turnover device 28, for rotating and translating packets 3*a*, and a conveyor 29 located in series with each other for transferring packets 3*a* from transfer station 27 to assembly device 10. Device 28 comprises a pocket device 30 fitted to a shaft 31 so as to rotate about an axis 31*a* substantially parallel to direction 14, and which is so timed in relation to suction heads 22 as to receive packets 3*a* from conveyor 17 at transfer station 27, and transfer them to conveyor 29 at an unloading station 32 after rotating 180° about axis 31*a*.

Figure 7:
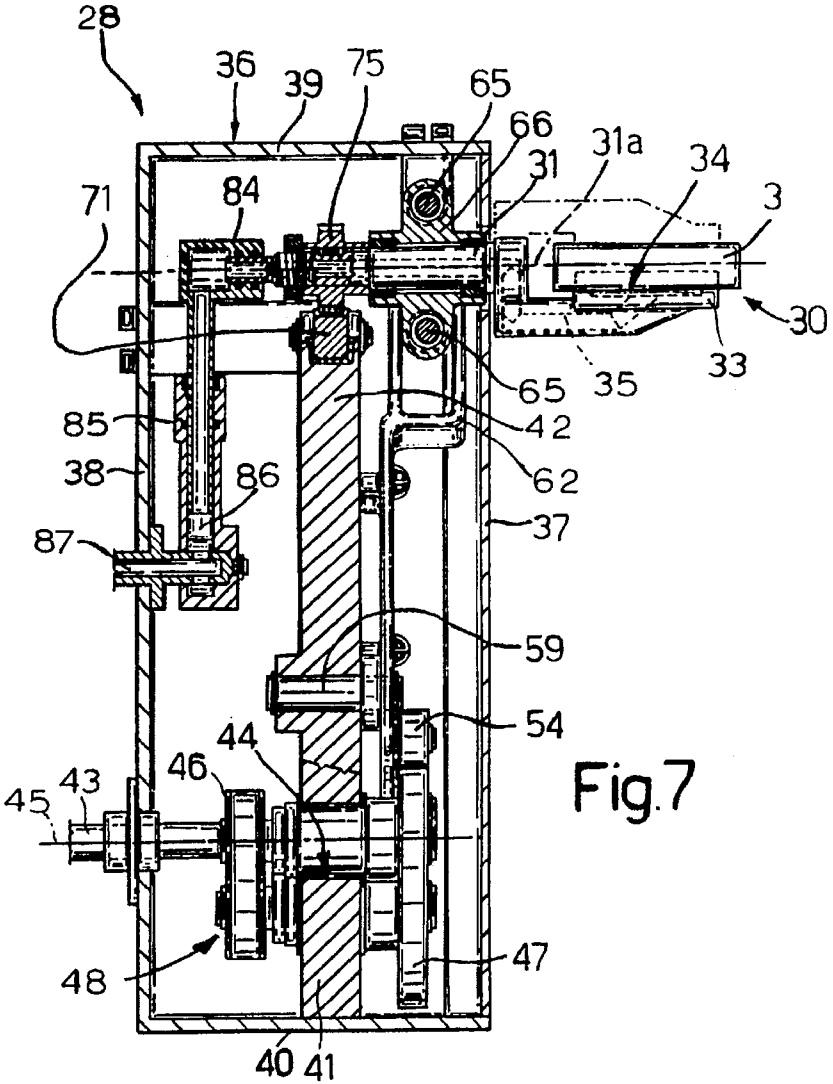
FIG. 7 shows a section along line VII—VII in FIG. 5

With reference to FIGS. 3 and 7, pocket device 30 presents a plate 33 defining a supporting surface 34 for packets 3*a* and presenting a through channel 35 communicating with a known suction device (not shown). Surface 34 is positioned upwards facing heads 22 at transfer station 27, and is positioned downwards facing conveyor 29 at unloading station 32.

With reference in particular to FIG. 7, device 28 comprises a casing 36 substantially in the form of a rectangular parallelepipedon and located in a fixed position with its longer longitudinal axis crosswise to axis 31*a*. Casing 36 comprises two vertical large lateral walls 37 and 38, the first facing conveyor 17; a top wall 39; a bottom wall 40; and an inner partition wall 41 extending upwards from wall 40, interposed between facing bottom portions of walls 37 and 38, and presenting an upper central appendix 42.

Figure 5:
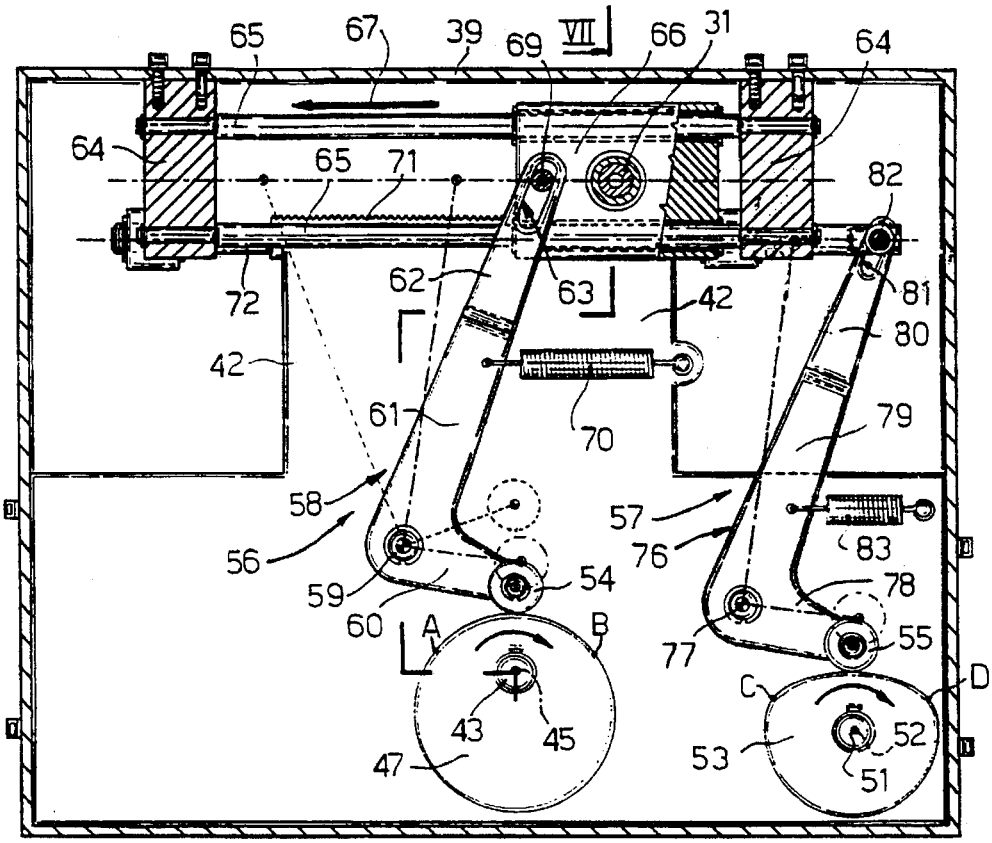
Figure 4:
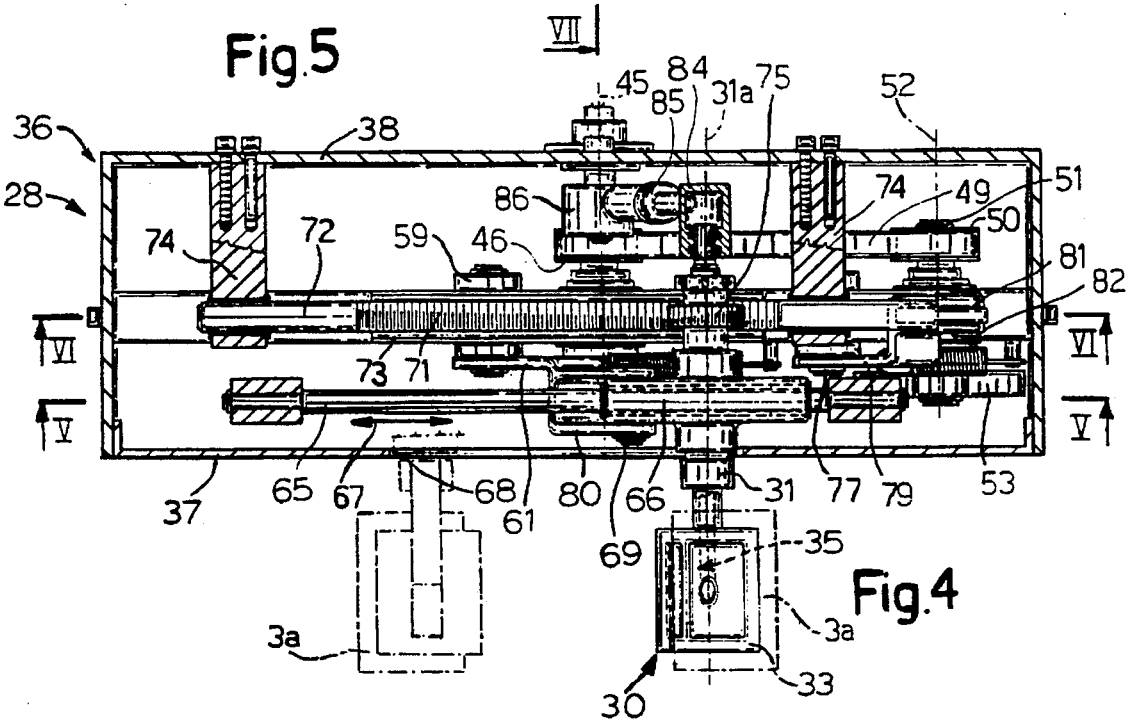
FIG. 4 shows a larger-scale plan view, with parts in section and parts removed for clarity, of a detail in FIG. 1.

Device 28 also comprises a drive shaft 43 fitted through wall 38 and a hole 44 formed through partition 41, so as to rotate clockwise (in FIG. 5) about its axis 45 parallel to axis 31*a*. Shaft 43 extends through partition 41, and is fitted with a pulley 46 between partition 41 and wall 38, and with a cam 47 between partition 41 and wall 37. As shown in FIGS. 4 and 5, by means of a belt drive 48 comprising a belt 49 looped about pulley 46 and a further pulley 50, shaft 43 is connected to a second shaft 51 mounted for rotation through partition 41 and about its axis 52 parallel to axis 45, and fitted on one end with pulley 50 and on the other end with a cam 53 on the same side of partition 41 as cam 47.

As shown in FIG. 5, cam 47 comprises a circular disk fitted eccentrically to shaft 43 and defining, for a respective tappet roller 54, a path comprising, in the rotation direction of cam 47, a first portion A-B closer to axis 45, and a second portion B-A further away from axis 45. Cam 53, on the other hand, is in the form of a circular disk coaxial with axis 52 and presenting a depressed lateral portion. More specifically, cam 53 defines, for a respective tappet roller 55, a path comprising, in the rotation direction of cam 53, a first portion C-D substantially similar to portion A-B, and a second portion D-C in the form of an arc of a circle coaxial with axis 52.

Cams 47 and 53 and respective tappet rollers 54 and 55 constitute the input members of a rototranslatory actuator device 56 and, respectively, a delay device 57, both housed in casing 36.

With reference in particular to FIGS. 4 and 5, actuator device 56 comprises a square rocker arm 58 pivoting on a shaft 59 fitted through partition 41 and parallel to axis 45; which rocker arm 58 comprises a first arm 60 parallel to partition 41 and fitted in rotary manner with roller 54, and a second arm consisting of a slotted link 61. Link 61 extends upwards from shaft 59, parallel to partition 41 and crosswise to arm 60, and presents a free end portion defined by a fork 62, the arms of which present respective axial slots 63. Actuator device 56 also comprises two brackets 64 extending downwards from wall 39 and supporting two superimposed guide rods 65 for a slide 66 mounted so as to slide along rods 65 in a substantially horizontal direction 67 crosswise to direction 14. Slide 66 supports in rotary manner shaft 31 which extends through an opening 68 formed through wall 37 and parallel to rods 65, and presents its axis 31*a* perpendicular to slide 66 and to the plane defined by rods 65.

Slide 66 presents a through pin 69 engaging in transversely sliding manner the slots 63 in fork 62 of link 61, so as to permit link 61 to move slide 66 back and forth along rods 65 by virtue of cam 47 and in opposition to the action of a return spring 70 interposed between link 61 and partition 41 and which provides for maintaining roller 54 permanently contacting the periphery of cam 47.

Actuator device 56 also comprises a rack 71 which is formed on a rod 72 parallel to rods 65, is mounted in axially sliding manner inside a rail 73 formed at the top of appendix 42, and presents opposite ends mounted in sliding manner through respective guide brackets 74 integral with wall 38. Rack 71 extends beneath shaft 31, and meshes with a sprocket 75 fitted to shaft 31.

As shown more clearly in FIG. 6, delay device 57 comprises a square rocker arm 76 pivoting on a shaft 77 fitted through partition 41 and parallel to axis 45; which rocker arm 76 comprises a first arm 78 parallel to partition 41 and fitted in rotary manner with roller 55, and a second arm consisting of a slotted link 79. Link 79 extends upwards from shaft 77, parallel to partition 41 and crosswise to arm 78, and presents a free end portion defined by a fork 80, the arms of which present respective axial slots 81. Slots 81 are engaged in transversely sliding manner by a pin 82 connected to one end of and crosswise to rod 72, to permit link 79 to move rod 72 back and forth along rail 73 by virtue of cam 53 and in opposition to the action of a return spring 83 interposed between link 79 and partition 41 and which provides for maintaining roller 55 permanently contacting the periphery of cam 53.

With reference to FIGS. 4 and 7, at the opposite end to that fitted with pocket device 30, shaft 31 is connected for rotation to a pneumatic fitting 84 connecting shaft 31 to one end of a telescopic tube 85 extending crosswise to shaft 31 inside casing 36 and defining a portion of suction channel 35. By means of a second pneumatic fitting 86, the other end of tube 85 is connected to a further tube 87 extending through wall 38 and connected to a known suction device (not shown).

As shown particularly in FIG. 1, conveyor 29 comprises a belt 88 looped about two pulleys 89 and 90—one of which is powered—and presenting an upper transportation branch for successively receiving packets 3*a* from pocket device 30 and feeding them in direction 67 at a first speed V1. Conveyor 29 extends alongside the output portion of a conveyor 91 constituting feed device 9 and comprising a belt 92 looped about two pulleys 93 and 94—one of which is powered—respectively located at station 27, and coaxial with pulley 90 at the input of assembly device 10. Conveyor 91 presents an upper transportation branch for successively receiving packets 3*b* from conveyor 17 and feeding them in direction 67 at a speed V2 differing from speed V1 and such as to permit simultaneous supply by conveyors 29 and 91 of two packets 3 separated and coaxial with each other along a respective axis 4*a*. A known gumming device (not shown) provides in known manner for gumming the outer surface of wall 5 of at least one of the two packets 3 before they reach the input of assembly device 10.

As shown in FIG. 1, once fed simultaneously to device 10, the two packets 3 are fed along device 10 by a known push member 95, and are pushed axially towards each other by two known lateral compacting belts 96 so that respective walls 5 adhere to each other to form a respective twin packet 2.

In actual use, packets 3, arranged with their longer longitudinal axes 4 parallel to direction 14 and aligned with one another along conveyor 11 with lids 15 facing forwards in direction 14, are fed to pickup station 26 in an orderly succession, substantially contacting one another, and each simultaneously with a respective suction head 22, 23. From each pair of adjacent packets 3 aligned along conveyor 11, a first packet 3*a* is gripped by a respective head 22 and translated, as stated, parallel to itself to transfer station 27 where it is released on to plate 33 of pocket device 30.

Just prior to packet 3*a* being released on to plate 33, device 28 is positioned as shown in FIG. 5, with rollers 54 and 55 contacting intermediate points of portions A-B and C-D respectively. As of the above position, rotation of cams 47 and 53 causes a simultaneous movement of links 61 and 79, which move slide 66 and rack 71 at substantially the same speed until rollers 54 and 55 reach respective points B and D. Throughout this time, in the absence of any relative motion of rack 71 and sprocket 75, no rotation occurs of shaft 31, so that surface 34 of plate 33 remains facing upwards in the horizontal position. As roller 54 moves from the initial FIG. 5 position to point B, slide 66 is gradually accelerated so that it travels through station 27 at the same speed as heads 22 and simultaneously with one of heads 22 to receive a packet 3*a*.

Upon roller 54 passing point B, and roller 55 simultaneously passing point D, link 61 continues moving to feed slide 66 in direction 67 towards the input end of conveyor 29, whereas link 79 is arrested and remains stationary as roller 55 travels along the whole of portion D-C. As a consequence of the angular displacement of link 61 in relation to link 79, rack 71 is moved in relation to sprocket 75 which, together with pocket device 30, is rotated 180° about axis 31*a* as roller 54 travels along and up to an intermediate point of portion B-A.

In other words, by axially displacing rack 71, delay device 57 permits plate 33 to rotate about axis 31*a* with a given delay in relation to the passage of plate 33 through station 27, so that plate 33 does not interfere, during its rotation, with head 22, and is maintained in a fixed upward position as packet 3*a* is transferred on to it from respective head 22.

The above operations are repeated in reverse order as rollers 54 and 55 travel from the intermediate points of respective portions B-A and D-C to the FIG. 5 position; and, at the same time, the packet 3*a* released by pocket device 30 on to conveyor 29 is fed by conveyor 29 to the input of assembly device 10.

From each pair of adjacent packets 3 aligned along conveyor 11, the second packet 3*b* is gripped by a respective head 23; is transferred, as stated, to transfer station 27, while at the same time being rotated 180° about axis 25 of respective shaft 21 and inwards of conveyor 17; is released, as oriented above, on to the input end of conveyor 91; and is fed by conveyor 91 in direction 67 so as to reach the input of assembly device 10 simultaneously with the corresponding packet 3*a* to form a respective twin packet 2.

We claim:

1. A method of producing twin packets (2) of cigarettes, each twin packet (2) including a pair of adjacent single packets (3*a*, 3*b*) comprising two single packets (3), each single packet having a respective lid opening end (15), an opposite closed end (5) and a longitudinal axis (4) through said ends, said single packets initially disposed in equioriented alignment with respective longitudinal axes (4) coaxially aligned with each other and equioriented wherein the closed end (5) of a first packet (3) is adjacent the lid opening end (15) of a second packet (3), the method comprising the steps of:

feeding the equioriented and aligned single packets (3) in an orderly succession and in a first direction (14) parallel to the longitudinal axes (4) of the single packets (3);

transferring two single packets (3) in each said pair of adjacent single packets (3) in said succession to respective feed devices (8, 9);

imparting to one of the single packets (3) in each pair a first 180° rotation about a second axis (24) perpendicular to the respective longitudinal axis (4);

feeding said two single packets (3) along the respective feed devices (8, 9), and in a second direction (67) perpendicular to the respective longitudinal axes (4) and to an assembly position (10) with the longitudinal axes (4) of the two single packets (3) coaxial with each other; and while feeding said two single packets (3) in said second direction (67), imparting to one of the single packets (3) in each said pair a second 180° rotation about the respective longitudinal axis (4) so that, in said assembly position (10), said twin packet (2) is formed wherein the two single packets (3a, 3b):

(a) have their respective longitudinal axes coaxially aligned to present a common longitudinal axis (4a); (b) are oppositely oriented in relation to each other along the common longitudinal axis (4a) with the respective closed ends (5) adjacent each other; and (c) are rotated 180° in relation to each other about the common longitudinal axis (4a) with the respective lid opening end (15) of one single packet (3a) being on one twin packet (2) side of the common longitudinal axis (4a) and the lid opening end (15) of the other single packet (3b) being on the opposite twin packet side of the common longitudinal axis.

2. A method as claimed in claim 1, wherein said first and second 180° rotations are imparted to different respective single packets (3) in each said pair of single packets.

3. A method as claimed in claim 1, wherein said second 180° rotation is imparted to a first (3a) of the single packets (3) in each said pair of single packets (3a, 3b) as the first single packet (3a) travels in said second direction (67).

4. A method as claimed in claim 3, wherein the travel of said first single packet (3a) in said second direction (67) comprises a first rototranslatory step wherein the first single packet (3a) is translated in the second direction (67) and turned 180° about its own longitudinal axis (4); and a second step wherein the overturned single packet (3a) is translated into the assembly position (10).

5. A method as claimed in claim 4, wherein the first single packet (3a) is turned over about the respective longitudinal axis (4) by rotating the longitudinal single packet (3a) about a third axis (31a) parallel to the first axis (4) in the course of said first rototranslatory step.

6. A method as claimed in claim 4, wherein said first rototranslatory step comprises a first part wherein the first single packet (3a) is translated in the second direction (67), and a second part wherein the first single packet is rotated about its own longitudinal axis (4) and at the same time is translated in the second direction (67).

7. A machine for producing twin packets (2) of cigarettes, each twin packet (2) including a pair of adjacent single packets (3a, 3b) comprising two single packets (3), each single packet having a respective lid opening end (15), an opposite closed end (5) and a longitudinal axis (4) through said ends, said single packets initially disposed in equioriented alignment with respective longitudinal axes (4) coaxially aligned with each other and equioriented wherein the closed end (5) of a first packet (3) is adjacent the lid opening end (15) of a second packet (3) the machine comprising:

first conveyor means (11) for feeding the equioriented and aligned single packets (3) in an orderly succession and in a first direction (14) parallel to the longitudinal axes (4) of the single packets (3);

first and second feed devices (8, 9) located substantially side by side, for receiving said orderly succession of single packets (3) and for feeding respective single packets (3) in a second direction (67) perpendicular to the respective longitudinal axes (4) to an assembly position;

transfer means (7) for transferring the single packets (3) in each said pair of adjacent single packets (3) in said succession from the first conveyor means (11) to respective said feed devices (8, 9), said transfer means (7) including first gripping means (22; 23) rotating about respective second axes (24; 25) for successively gripping the single packets (3) and imparting to one (3a) of the single packets (3) in each said pair a first 180° rotation about a second axis (24) perpendicular to the respective longitudinal axis (4);

a turnover device (28) including a rotary support (30) rotating about a third axis (31a) substantially perpendicular to the second axis (24) for receiving one single packet (3a) of each said pair with its longitudinal axis (4) parallel to said third axis (31a); and actuating means (56) for imparting to the rotary support (30) a second 180° rotation about the third axis (31a) so that said twin packet (2) is formed wherein the two single packets (3a, 3b): (a) have their respective longitudinal axes coaxially aligned to present a common longitudinal axis (4a); (b) are oppositely oriented in relation to each other along the common longitudinal axis (4a), with the respective closed ends adjacent each other; and (c) are rotated 180° in relation to each other about the common longitudinal axis (4a) with the respective lid opening end (15) of one single packet (3a) being on one twin packet (2) side of the common longitudinal axis (4a) and the lid opening end (15) of the other single packet (3b) being on the opposite twin packet side of the common longitudinal axis.

8. A machine as claimed in claim 7, wherein said turnover device (28) forms part of said first feed device.

9. A machine as claimed in claim 8, wherein said first feed device (8) includes second conveyor means (29) arranged in series in said second direction (67) and between the transfer means (7) and said assembly position (10); said actuating means (56) comprising a rototranslatory actuator device (56) for imparting said second 180° rotation to said rotary support (30).

10. A machine as claimed in claim 9, wherein the turnover device (28) also comprises a delay device (57) associated with the rototranslatory actuator device (56).

11. A machine as claimed in claim 10, wherein the actuator device (56) comprises a slide (66); first drive means (47, 58) for imparting to the slide (66) a reciprocating motion and a first given travel distance in said second direction (67); a sprocket (75) integral with said support, mounted on said slide (66), and rotating with the support (30) about the third axis (31a); and a rack (71) extending in the second direction (67) and meshing with the sprocket (75).

12. A machine as claimed in claim 11, wherein the delay device (57) comprises second drive means (53, 76) connected to said rack (71), for imparting to the rack (71) a reciprocating motion in said second direction (67) and a second given travel distance shorter than said first given travel distance and extending along a portion of the first travel distance; said first and second drive means (47, 58; 53, 76) enabling, for at least part of said portion of the first travel distance, the rack (71) and the third axis (31a) to travel at the same speed.

* * * * *